US006755415B2

(12) United States Patent
Werner et al.

(10) Patent No.: US 6,755,415 B2
(45) Date of Patent: Jun. 29, 2004

(54) LEAF TREATMENT DEVICE AND A METHOD FOR ADJUSTING A LEAF TREATMENT DEVICE

(75) Inventors: Frank Werner, München (DE); Alois Wagner, Olching (DE); Ralf Linck, München (DE)

(73) Assignee: Giesecke & Devrient GmbH, Munich (DE)

( * ) Notice: Subject to any disclaimer, the term of this patent is extended or adjusted under 35 U.S.C. 154(b) by 0 days.

(21) Appl. No.: 10/221,190

(22) PCT Filed: Mar. 21, 2001

(86) PCT No.: PCT/EP01/03213

§ 371 (c)(1),
(2), (4) Date: Dec. 2, 2002

(87) PCT Pub. No.: WO01/70610

PCT Pub. Date: Sep. 27, 2001

(65) Prior Publication Data

US 2003/0121838 A1 Jul. 3, 2003

(30) Foreign Application Priority Data

Mar. 23, 2000 (DE) ..... 100 14 440

(51) Int. Cl.[7] ..... B65H 5/22; B65H 83/00; B65H 85/00; B65H 29/40; B65H 29/00

(52) U.S. Cl. ..... 271/315; 209/534

(58) Field of Search ..... 271/3.15, 3.06, 271/178, 187, 315; 209/1, 534; B65H 5/22, 83/00, 85/00, 29/40, 29/00, 29/20

(56) References Cited

U.S. PATENT DOCUMENTS

| | | | | |
|---|---|---|---|---|
| 4,244,565 A | | 1/1981 | Geier | |
| 4,381,447 A | | 4/1983 | Horvath et al. | |
| 4,420,153 A | | 12/1983 | Reed et al. | |
| 4,657,241 A | * | 4/1987 | Frank | 271/305 |
| 4,790,526 A | | 12/1988 | Egashira | |
| 4,881,731 A | | 11/1989 | Simpson-Davis | |
| 4,915,371 A | | 4/1990 | Quinton | |
| 5,617,956 A | * | 4/1997 | Werner et al. | 209/534 |
| 6,267,367 B1 | * | 7/2001 | Pfankuch | 271/3.05 |

FOREIGN PATENT DOCUMENTS

| | | |
|---|---|---|
| DE | 31 37 253 A1 | 6/1982 |
| DE | 32 01 956 A1 | 10/1982 |
| DE | 35 38 309 C2 | 5/1986 |
| EP | 0 308 057 A | 3/1989 |
| GB | 2 093 809 A | 9/1982 |
| GB | 2 168 687 A | 6/1986 |
| JP | 56065757 | 6/1981 |
| JP | 61130159 | 6/1986 |

* cited by examiner

*Primary Examiner*—Donald P. Walsh
*Assistant Examiner*—Kenneth W Bower
(74) *Attorney, Agent, or Firm*—Bacon & Thomas, PLLC

(57) ABSTRACT

In a sheet-processing apparatus, banknotes are separated by a separator (10) and fed to a depositing arrangement (18) via a sensor and transporting unit (8). Depositing takes place in different depositing compartments in accordance with depositing criteria which are determined by certain features of the banknotes (BN) being sensed. The individual depositing compartments (30, 32, 34) of the depositing arrangement (18) are assigned stacker wheels (20, 22, 24), which have stacker fingers which, in pairs, define a sheet compartment between them. The banknotes are introduced into the sheet compartments and are then deposited in the associated depositing compartment by the stacker fingers. In order to prevent fed banknotes from coming into contact with stacker-finger tips and then not being deposited correctly, the rotational speed (including phase) of the stacker wheels (20, 22, 24) is synchronized with the operating frequency of the separator (10) such that the individual banknotes enter centrally into the sheet compartments of the stacker wheels.

12 Claims, 3 Drawing Sheets

LEAF TREATMENT DEVICE AND A METHOD FOR ADJUSTING A LEAF TREATMENT DEVICE

The invention relates to a sheet-processing apparatus for depositing sheets, in particular banknotes, in stacks, and also relates to a process for setting up such a sheet-processing apparatus.

The invention will be explained hereinbelow specifically using the example of a banknote-processing apparatus, but it goes without saying that it is also possible for other "sheets" to be processed by the sheet-processing apparatus.

Banknotes occurring in relatively large quantities can be processed by known sheet-processing apparatuses such that damaged and/or worn banknotes are separated from banknotes in good condition and are deposited in different depositing compartments. It is also possible for banknotes of different formats and/or denominations to be sorted and deposited as stacks in different compartments.

Known sheet-processing apparatuses usually contain a separator which separates banknotes from a stack of banknotes of different qualities (banknotes in good condition and those in poor condition, banknotes of different formats, etc.), transfers the separated banknotes to a transporting unit and, with the aid of a sensor device, checks quality features in order to form depositing criteria, whereupon the banknotes are transported from the transporting unit to different depositing compartments, in dependence in each case on the depositing criteria determined. Each depositing compartment is assigned a stacker wheel. A stacker wheel contains stacker fingers which run helically on a disk-like or roller-like carrier, the wheel being driven in a direction which is counter to the orientation of the stacker-finger tips.

The separated banknotes, which are being processed in respect of their selection criteria by the sensor device and are directed to one of the plurality of stacker wheels in accordance with the selection criteria, are directed into a sheet compartment which is formed between in each case two adjacent stacker fingers. The individual stacker fingers have a smaller width than the banknotes and have their outer ends running through a stop wall of a depositing compartment. The banknotes located in the individual sheet compartments are moved towards the base of the depositing compartment by the rotation of the stacker wheel, while the leading edge of the banknote, directed toward the center of the stacker wheel, is retained against the stop wall of the depositing compartment and moved along said wall in the direction of the base of the depositing compartment.

Such sheet-processing apparatuses with the individual components are known. You are referred, for example, to DE 29 02 068 C2, which discloses a separator. A typical feature for a separator is a stack of sheets (stack of banknotes) which is moved against a retaining rack, in the vicinity of which is located a separator wheel, certain locations of which are subjected to negative pressure. The rotational speed of said separator wheel determines the frequency at which individual banknotes are discharged by the separator.

In order that the sheet-processing apparatus operates properly and the individual sheets (banknotes) are deposited correctly in the individual depositing compartments, each sheet compartment in each stacker wheel should only accommodate a single sheet. For this reason, the rotational speed (excluding in phase position) of the individual stacker wheels is set such that—in dependence on the frequency at which the separator discharges the banknotes—not more than one banknote passages into a sheet compartment. The rotational speed of the stacker wheels is expediently set such that, on average, more than one sheet compartment is available for one banknote in each case.

In the case of the known sheet-processing apparatus, although the abovementioned setting of the rotational speed of the individual stacker wheels achieves a situation where no more than one banknote should pass into a sheet compartment of the stacker wheel, it may nevertheless be the case that a banknote strikes against a stacker-finger tip by way of its leading border. In the worst-case scenario, the banknote is slung out of the apparatus and possibly prevents other banknotes from being deposited. It is at least the case, however, that the banknotes coming into contact with the tip of a stacker finger are braked in an undefined manner and, accordingly, are not deposited correctly. Banknotes which pass into two sheet compartments, that is to say pass into the helical wheel obliquely in front of and behind the associated stacker-finger tips, may likewise affect the operation of other banknotes being deposited.

In the case of relatively small sheet-processing apparatuses, such as counting machines, which have a separator, a transporting unit, sensors and one or more depositing compartments, the separator is frequently designed as a friction-wheel separator. In addition, it is possible for the housing and/or the transporting unit to be opened, for example for eliminating jams. This results in further problems when banknotes are deposited in the depositing compartments.

The object of the invention is to specify a sheet-processing apparatus of the type described above which ensures that the individual sheets are accommodated correctly in a sheet compartment of a stacker wheel and, accordingly, are deposited neatly.

It is also intended to specify a process which is intended for setting up a sheet-processing apparatus of the type described above and which guarantees that the sheet-processing apparatus operates properly, that is to say that the individual sheets are deposited correctly at all times.

This object is achieved according to the invention in that the rotational speed of the stacker wheels is synchronized with the frequency of the sheets discharged by the separator, to be precise such that each sheet entering into the sheet compartment of the stacker wheel passes approximately centrally through the opening between two adjacent stacker-finger tips. The phrases "the sheet passes centrally through the opening of the sheet compartment", "the sheet enters approximately centrally between two stacker-finger tips of a sheet compartment" and the like, in the present context, mean that the sheet running into a sheet compartment is spaced apart, by way of its leading edge, to a sufficient extent both from the tip of the preceding stacker finger and from the tip of the following stacker finger, that is to say cannot in any case collide with the tip of a stacker finger. In the invention, the use of a common drive motor, with rigid mechanical coupling, would force the separator and the stacker wheels to run synchronously. Nevertheless, in order to achieve in-phase synchronization, that is to say in order for each sheet to run centrally into a sheet compartment of the stacker wheel, it is necessary to set the position of the separator wheel relative to the position of the stacker wheels. For this purpose, in the case of the common drive motor, a clutch is then arranged, in conjunction with a brake, between said drive motor and the separator. Before the beginning of the stacking operation, the drive motor is set in motion until the separator reaches a previously defined synchronizing position. The separator is then uncoupled from the common drive motor. The brake keeps the separator in the defined synchronization position. The stacker wheels (together with the sheet-transporting means) are then rotated further by the drive motor until they too have reached the previously defined synchronizing position, that is to say until the synchronization-signal transmitter assigned to the stacker wheels supplies the synchronizing pulse. At that moment, the force fit between the common drive motor and the separator is re-established, with the result that the separator and stacker wheels then rotate synchronously in phase.

The above initializing sequence can be carried out before the sheet-processing apparatus is brought into operation in each case, but at least following each instance of intervention in the machine, for example following each cleaning operation or following each time a sheet jam is eliminated, etc. If it proves to be the case in a check during operation that, on account of signs of a drift, the individual sheets arrive at a relatively large distance from the center of the sheet-compartment opening, then it is possible for the machine to be stopped and for an initializing sequence to be introduced.

The synchronization between the separator, on the one hand, and the stacker wheels (and the transporting means located therebetween), on the other hand, implies that the stacker wheels are synchronized with one another. This can expediently be achieved mechanically with the aid of one or more toothed belts, by means of which in each case at least two stacker wheels are coupled. Seated on the axes of rotation of the stacker wheels are gearwheels, around which the associated toothed belt is wound. In the sheet-processing apparatus, the sheets (banknotes) fed to the different stacker wheels and depositing compartments, following their distribution in dependence on the depositing criteria determined, cover transporting paths which are possibly of different lengths. For this reason, the stacker wheels are also set with different "phase positions", namely such that the sheet arriving sooner or later at the respective stacker wheel in dependence on the length of the transporting path passes into the center of a sheet-compartment opening.

A particularly straightforward arrangement with fixed synchronization is achieved when the gearwheel for the toothed belt, which is assigned to a respective stacker wheel, is provided with a number of teeth which corresponds to the number of sheet compartments. The setting of the stacker wheels on their axes of rotation in relation to the setting of the rest of the stacker wheels takes place a single time in the necessary phase position in dependence on the individual transporting-path length. If, on a stacker wheel, the associated gearwheel has the same number of teeth as the stacker wheel has sheet compartments, it is even possible, during later operation, for the toothed belt to jump by one or more teeth without adversely affecting the synchronization of the stacker wheels in relation to one another.

As far as the synchronization between the separator, on the one hand, and the stacker wheels, on the other hand, is concerned, in each case one synchronization-signal transmitter is expediently assigned to the separator, on the one hand, and all the stacker wheels, on the other hand. Such a signal transmitter is, for example, in the form of a Hall sensor in conjunction with a magnet arranged on the revolving wheel of the separator and/or a magnet arranged on a stacker wheel, with the result that, in the case of defined positions of the relevant wheels, the associated Hall sensor supplies a pulse signal as a synchronization signal. The electronic control means of the apparatus can then carry out the synchronization according to the invention between the separator and stacking wheels with the aid of said synchronization signals.

Depending on the type of machine, the stacker wheels, on the one hand, and the separator, on the other hand, each have a dedicated drive motor or they have a common drive motor.

The constant monitoring and readjustment for maintaining optimized synchronization between the separator and stacker wheels can also be carried out if the separator and the stacker wheels each have a separate drive motor. Dispensing with the coupling and braking arrangement for the separator, both the separator and the group of stacker wheels each supply a synchronization signal to a control device, the control device then initially allowing an initializing sequence, which is similar to the abovedescribed initializing sequence, to proceed. During operation, it is then also possible for the control device, with the aid of the synchronization signals, to detect a possible increasing phase deviation between the synchronization signals and to readjust the same correspondingly.

The operation of properly depositing the individual sheets or banknotes is possibly also adversely affected in the prior art by a sheet located in one sheet compartment of the stacker wheel colliding with a sheet located in an adjacent sheet compartment. If, for example, a banknote is dog-eared or has tears, parts of the banknote project out of the "plane" of the banknote, which possibly constitutes an obstruction for a banknote moving in the vicinity. In order to avoid individual banknotes being obstructed in this way by adjacent, damaged banknotes, the invention provides, in an independently protected configuration for a stacker wheel, that the stacker fingers of the latter have a defined minimum thickness, which guarantees a minimum spacing between parts of a sheet in one sheet compartment and a sheet located in an adjacent sheet compartment. The stacker fingers may preferably be of double-walled design, with the result that, despite the increased minimum thickness, they only have a low weight.

The thickened individual stacker fingers guarantee a minimum spacing between adjacent sheets in the stacker wheel, with the result that dog-ears or tears in one sheet do not constitute an obstruction for an adjacent sheet.

The synchronization according to the invention of the separator and the stacker wheels can be achieved with the aid of the hardware measures discussed in more detail above.

The synchronization according to the invention is achieved by a process according to the invention which, in the case of sheet-processing apparatuses, can be achieved by appropriate programming, provided that such a sheet-processing apparatus has means for synchronizing the plurality of stacker wheels with one another and for receiving synchronization signals in the stacker wheels, on the one hand, and from the separator, on the other hand. The process according to the invention provides the following steps: prior to operation, an initializing routine is carried out, this involving the separator and the synchronously running stacker wheels being synchronized with one another such that each sheet running into one of the sheet compartments has its leading edge running through the opening of the sheet compartment approximately centrally between the tips of the stacker fingers. For this purpose, in detail, the following steps are carried out:

- the separator is moved into a defined synchronizing position and stopped there;
- the stacker wheels are then moved into a defined synchronizing position (and possibly stopped there), and
- from the respective synchronizing positions, the separator and the stacker wheels are then accelerated to the operating speed for the stacking operation.

Exemplary embodiments of the invention are explained in more detail hereinbelow with reference to the drawing, in which.

As has already been mentioned in the introduction, the present invention will be described with reference to exemplary embodiments which relate to the processing of banknotes, but it is obvious to the person skilled in the art that it is also possible for "sheets" other than those in the form of banknotes to be processed.

Figure 1:
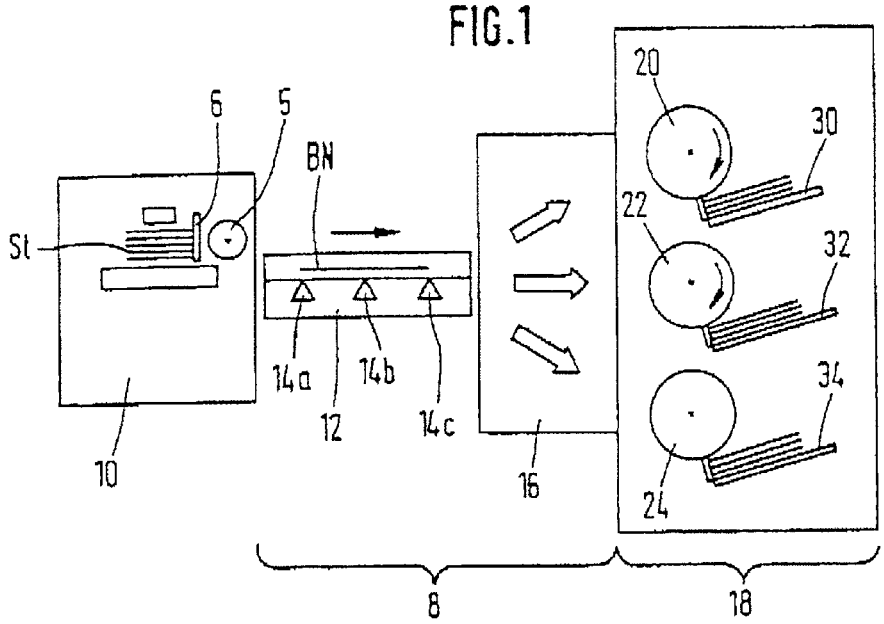
FIG. 1 shows a schematic illustration of a sheet-processing apparatus.

According to FIG. 1, a separator 10, which is illustrated schematically as a block, has located in it, on a rest which is not illustrated specifically, a banknote stack St, which has the leading edges of the individual banknotes striking against a retaining rack 6. A separator wheel 5, which is only illustrated schematically here but is designed in a manner known per se, and certain locations of which are subjected to negative pressure, supplies separated banknotes BN to a transporting and sensor device 12 at a predetermined frequency. It is likewise possible for the separator 10 to be designed as a friction-wheel separator. Applying friction material in segments to the separator wheel 5 achieves a predetermined frequency for the separation, in a manner similar to the negative-pressure variant.

The banknotes BN discharged by the separator 10 have a certain leading-edge spacing and a certain speed, that is to say the abovementioned certain frequency which, inter alia, depends on the rotational speed of the separator wheel 5. Transporting means (not illustrated specifically) in the transporting and sensor device 12, for example transporting rollers or belts, transport each separated banknote BN past schematically illustrated sensors 14*a*, 14*b* and 14*c* at a speed which is coordinated with the discharging frequency of the separator 10, said sensors sensing certain quality features of the banknotes, as is known per se. Such quality features are, for example, the degree of wear of the banknote, the format of the banknote (length, width), color of the banknote, security features of the banknote, etc.

The quality features supplied by the sensors 14*a*, 14*b* and 14*c* constitute depositing criteria which are evaluated by a control device (not illustrated), which receives signals from the sensors, in order, in dependence on the selection criteria determined, to feed the individual banknotes to one of a plurality of depositing compartments.

For this purpose, the transporting and sensor device 12 is adjoined by a distributor 16, which is designed in a manner known per se and is thus only indicated, in terms of its function, by a number of arrows.

The transporting and sensor device, 12 and the distributor 16 form a sensor and transporting unit 8, which can be accommodated together with the separator 10 in a single housing. The depositing arrangement 18, which adjoins the distributor 16, may also be formed in this housing. For normal operation, that is to say with the housing of the sheet-processing apparatus closed, the transporting unit 8 and depositing arrangement 18 are connected to one another such that they run synchronously with one another.

As is likewise known per se, the depositing arrangement 18 (only illustrated schematically in FIG. 1) contains a plurality of, in the present case three, stacker wheels 20, 22 and 24 with respectively associated depositing compartments 30, 32 and 34. The stacker wheels are driven together with the transporting means (not illustrated) in the sensor and transporting unit 8.

The configuration of the individual stacker wheels and depositing compartments within the depositing arrangement 18 is known per se, but will be explained in more detail with reference to FIG. 2 in order to give a better understanding of the invention.

Figure 2:
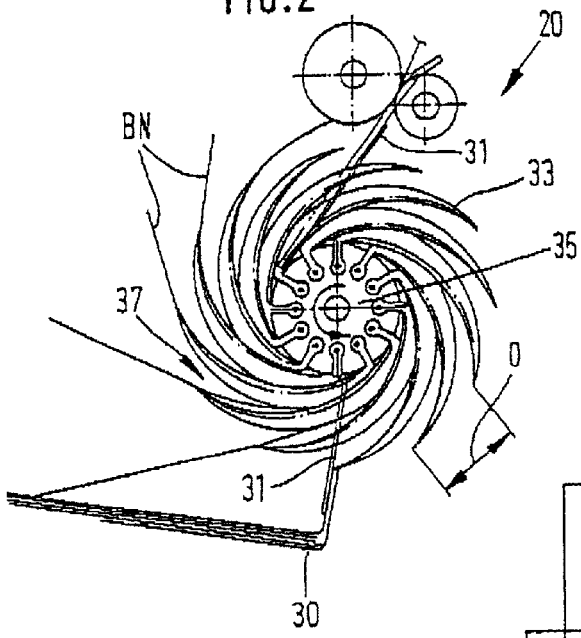
FIG. 2 shows a side view of a banknote-depositing compartment with associated stacker wheel.

FIG. 2 shows a view, which has been rotated in relation to the illustration on the right of FIG. 1, of a stacker wheel 20 with associated depositing compartment 30. The banknotes BN are directed from above, through the gap between two transporting rollers, onto a guiding and stop part 31, which encloses the stacker wheel 20 laterally on both sides. The stacker wheel 20 has helically running stacker fingers 33 which taper to a point at the end and of which the inner ends are fastened on a disk-like finger carrier 35. In the case of the present exemplary embodiment, the finger carrier 35 bears twelve stacker fingers 33.

In each case two adjacent stacker fingers 33 form between them a sheet compartment 37 for accommodating a single banknote BN.

The stacker wheel 20, which rotates in the arrow direction (in the counterclockwise direction in FIG. 2), with the banknotes BN accommodated in the individual sheet compartments 37, moves the banknotes as far as the approximately vertically running stop region of the guiding and stop part 31, with the result that the individual banknotes then slide downward, by way of the leading edge, in the direction of the base of the depositing compartment 30. The construction and functioning of such stacker wheels are known per se. A special feature according to the invention, in the case of the stacker wheel illustrated in FIG. 2, however is the relatively large thickness of the individual stacker fingers 33. The stacker fingers 33 may be designed as hollow bodies and have a thickness which guarantees that the banknotes accommodated in adjacent sheet compartments 37 do not collide with one another even when they are dog-eared or have tears. In other words, the banknotes BN accommodated in adjacent sheet compartments are spaced apart from one another by a sufficient minimum spacing, with the result that unobstructed movement of the individual banknotes guarantees that the latter are deposited properly in the depositing compartment 30.

When a banknote is introduced into a sheet compartment 37, it may be the case in the prior art that the leading edge of the incoming banknote BN strikes against a tip of the stacker finger 33 crossing over the path of the banknote, and possibly slings the latter away. In not quite as serious a case, the incoming banknote is braked in an undefined manner and then—because it is not accommodated correctly in the associated sheet compartment 37—is not deposited correctly in the depositing compartment 30.

The invention achieves the situation where each banknote BN enters approximately in the center between two adjacent stacker-finger tips. The opening defined between two adjacent tips of stacker fingers is designated ○ in FIG. 2. Suitable synchronization between the separator 10 and the stacker wheels results in the leading edge of each banknote entering centrally into the opening ○, "centrally" here meaning that the banknote is spaced apart sufficiently both from the preceding stacker-finger tip and from the following stacker-finger tip.

As can be seen from the right-hand part of FIG. 1, the individual distributed banknotes have transporting paths of different lengths in the distributor 16 and, accordingly, enter the associated stacker wheel 20, 22 and 24 at different times. The extent of slippage of the banknotes possibly caused by the transporting means, in the case of the transporting rollers or belts which are usually used, is very low and, as far as the present considerations are concerned, is negligible, and it is also the case that the overall transporting route, in particular in the case of relatively small sheet-processing apparatuses, is small. In order to achieve synchronization between the stacker wheels, on the one hand, and the separator 10, on the other hand, it is first of all necessary to synchronize the stacker wheels with one another.

Figure 3:
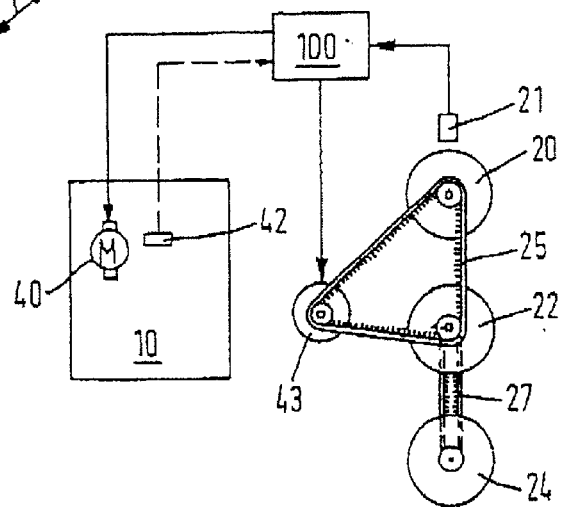
FIG. 3 shows a block diagram of an embodiment of the sheet-processing apparatus according to the invention with separate drive motor for a separator, on the one hand, and a group of stacker wheels, on the other hand.

FIG. 3 shows a preferred configuration for synchronizing the stacker wheels 20, 22 and 24, which are driven together by a stacker-wheel drive motor 43 via toothed belts 25 and 27. The toothed belts 25 and 27 couple the drive motor 43 directly to the stacker wheels 20 and 22 and indirectly to the stacker wheel 24. In the case of a certain position of the stacker wheel 20 (and thus also of the other two stacker wheels 22 and 24), a synchronization-signal transmitter 21 designed as a Hall element supplies a synchronization signal to an electronic control device 100. The latter also receives a synchronization signal from a synchronization-signal transmitter 42 (likewise designed as a Hall element), which is assigned to a separate drive motor 40 of the separator 10.

The electronic control device 100 receives the synchronization signals from the separator and from the stacker wheels and controls the drive motors 40 and 43 such that the separator, on the one hand, and stacker wheels, on the other hand, run synchronously and with a predetermined phase relationship in relation to one another.

Before the synchronizing operation is discussed in more detail, an alternative embodiment to the embodiment according to FIG. 3 will be explained first of all.

Figure 4:
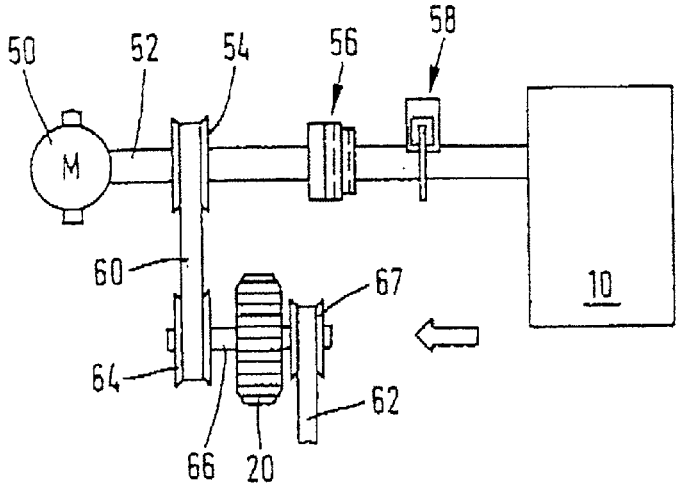
FIG. 4 shows an alternative embodiment of a sheet-processing apparatus according to the invention with a common drive motor for a separator and a group of stacker wheels.

FIG. 4 shows part of a sheet-processing apparatus which operates with a common drive motor for the separator 10, transporting unit (not illustrated) and the stacking wheel.

A common drive motor 50 is coupled to the separator 10 via a shaft 52 and a clutch 56. Seated on the shaft 52 is a gearwheel (toothed-belt wheel) 54, which is coupled via a toothed belt 60 to a gearwheel 64, which drives the stacker wheel 20 via a shaft 66. Seated on the shaft 66 is a further gearwheel 67, which drives the rest of the stacker wheels (not illustrated in FIG. 4) via a further toothed belt 62.

The common drive motor 50 is thus coupled rigidly to the stacker wheels via the gearwheels and toothed belts and the connection to the separator 10 can be released by the clutch 56, a brake 58 assigned to the drive shaft 52 behind the clutch 56 allowing the separator 10 to be stopped in a defined manner.

Figure 5:
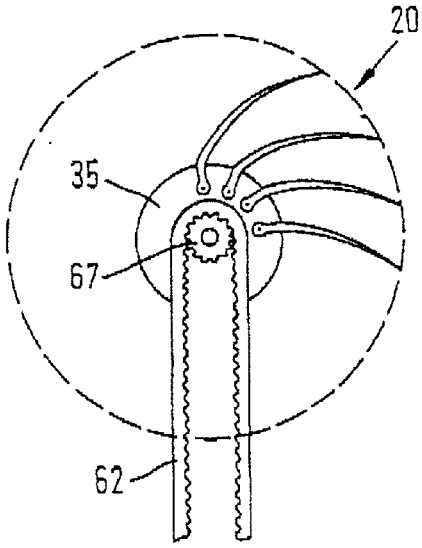
FIG. 5 shows a simplified illustration of part of a stacker wheel with associated driving gearwheel, on which a toothed belt is seated.

FIG. 5 shows an enlarged and partly simplified illustration of the stacker wheel 20 with the finger carrier 35 and the gearwheel 67, over which the toothed belt 62 is guided (view according to arrow direction V in FIG. 4).

Figure 6:
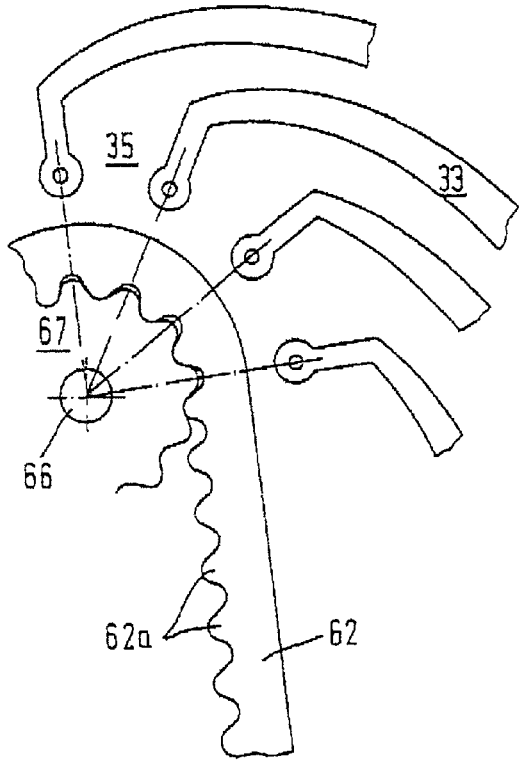
FIG. 6 shows an enlarged illustration of a detail from FIG. 5.

FIG. 6 shows the illustration according to FIG. 5 on a further-enlarged scale. As is indicated by chain-dotted lines, in each case one stacker finger 33 is assigned a tooth of the gearwheel 67. The chain-dotted lines in FIG. 6 connect the locations at which the individual stacker fingers 33 are fitted on the finger carrier 35 to the shaft 66 of the gearwheel 67. In this case, a chain-dotted line passes in each through a tooth of the gearwheel 67 and a fitting location of the stacker finger 33.

The advantage of the abovedescribed configuration, illustrated in more detail in FIGS. 5 and 6, of the stacker wheels with the associated driving gearwheel 67 is that even when the toothed belt 6 jumps, that is to say when the teeth 62*a* of the latter jump forward or back on the gearwheel 67 by a tooth spacing, the driving gearwheel and stacker fingers and/or sheet compartments are still positioned in a defined manner in relation to one another, and a phase relationship relative to the other stacker wheels thus still remains unchanged. Using gearwheels 67 with a number of teeth which is a whole-numbered multiple of the number of sheet compartments or can be divided by the number of sheet compartments to give a whole number achieves at least an easier setting capability for the individual stacker wheels.

Synchronization-signal transmitter and control device are not illustrated in FIG. 4, but, as in the case of the variant according to FIG. 3, the separator 10 and the stacker wheel 20 in FIG. 4 also each have a synchronization-signal transmitter.

The functioning of the abovedescribed sheet-processing apparatus will be explained hereinbelow, with particular consideration being given to the synchronization between the separator and stacking wheels.

If, according to FIG. 1, a separated banknote BN runs from the separator 10 to one of the stacker wheels, for example to the stacker wheel 20, this requires a certain period of time, which depends on the length of the transporting path and on the transporting speed. Since the paths to the different stacker wheels 20, 22 and 24 are of different lengths, a banknote needs a somewhat longer period of time to reach the stacker wheel 20, for example, than to reach the stacker wheel 22. The frequency of the banknotes arriving at one of the stacker wheels 20, 22 and 24 corresponds to the frequency of the banknote being discharged at the separator 10. The stacker wheels 20, 22 and 24 are thus driven at a rotational speed which is coordinated with the banknote-discharging frequency of the separator 10. The phase relationship between the stacker wheels 20, 22 and 24 is set to take account of the different lengths of transporting paths to the individual stacker wheels. Moreover, the phase relationship between the operation of the separator and all the stacker wheels 20, 22 and 24 with synchronization being present is set such that the banknotes pass centrally into the individual sheet compartments 37 (see FIG. 2).

A look at FIG. 2 shows that, depending on whether the stacker wheel 20 is leading or lagging, the incoming banknotes BN move closer to the preceding or the following tip of the adjacent stacker fingers 33 forming a sheet compartment 37.

In order that the individual banknotes enter centrally into the opening ○ in FIG. 2, prior to operation of the sheet-processing apparatus, an initializing sequence or routine is carried out, this being explained hereinbelow with reference to FIG. 7. An initializing sequence or routine is carried out, for example, whenever—as mentioned in the introduction—the sheet-processing apparatus or the housing thereof has been opened in order to eliminate jams. Synchronization is necessary when the sheet-processing apparatus has been stopped during the separating operation. This is because, in this case, the separator wheel is stopped while the transporting unit and the stacker wheels continue running until all the banknotes which have already been separated and are already located in the transporting unit have been deposited in the depositing compartments. Such states may be monitored, for example, by means of sensors and, when the normal operating state is re-established, e.g. once the housing has been closed, an initializing sequence or routine can be carried out automatically.

Figure 7:
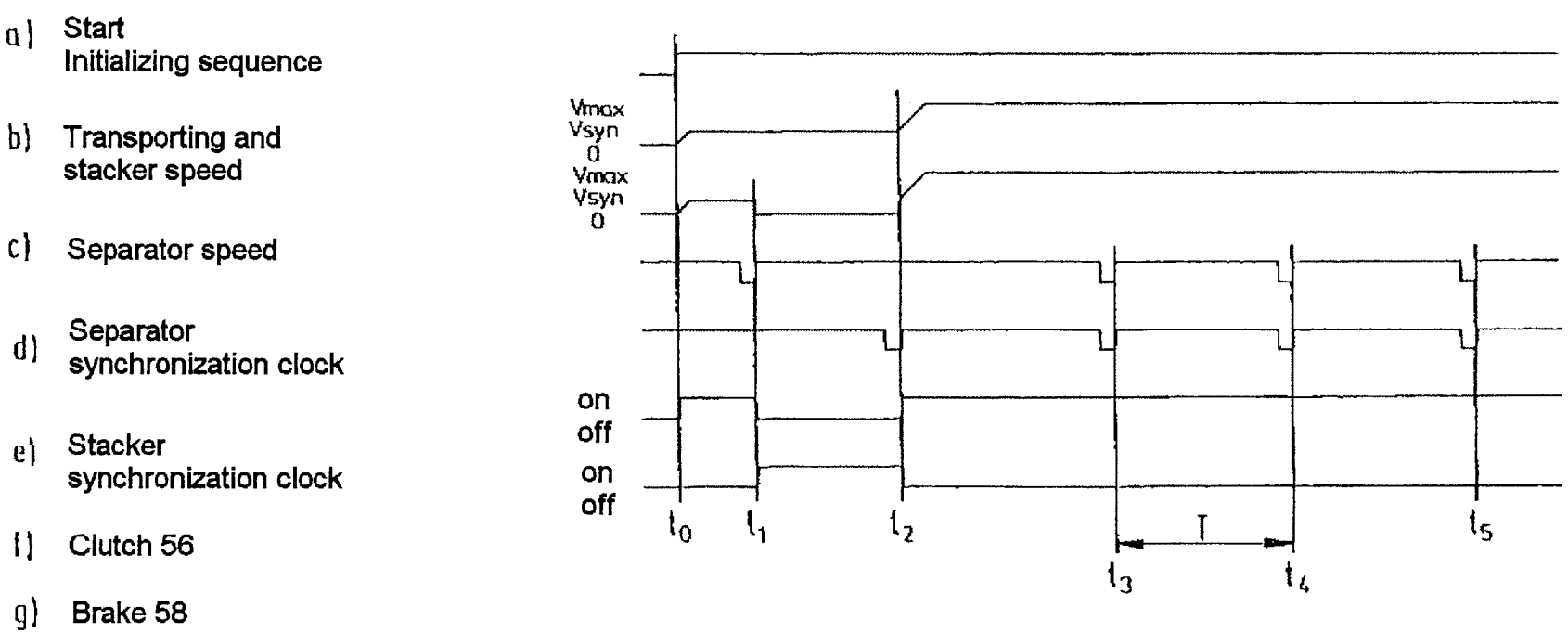
FIG. 7 shows a pulse diagram which, by way of different signal profiles, illustrates the course of an initializing routine in accordance with a process according to the invention for synchronizing a sheet-processing apparatus.

At the point in time t0 the initializing sequence is started, as is illustrated by the jump in level from "0" to "1" in FIG. 7*a*). FIG. 7 relates, in particular, to the embodiment according to FIG. 4, that is to say the embodiment with common drive motor for the separator and stacker wheels. The control device (not illustrated in FIG. 4) brings the drive motor 50 into operation at the beginning of the start signal, and accordingly the separator and the stacker wheels start up. This is illustrated following the point in time t0 in FIG. 7 by an increase in the transporting and stacker speed at b) and in the separator speed at c). Once the synchronization speed Vsyn has been reached, the separator 10 then reaches a position in which the synchronization-signal transmitter assigned to it supplies a separator synchronization clock signal, which is illustrated at d) in FIG. 7. As a result of this separator synchronization clock, the control device uncouples the clutch 56, that is to say separates the drive motor 50 from the separator, and actuates the brake 58, with the result that the separator 10 remains in this synchronizing position.

Despite the separator stopping, the common drive motor 50, via the gearwheel/toothed-belt connection, rotates the stacker wheels, as can be seen from the continuous synchronization speed Vsyn at b) in FIG. 7. During the time between t1 and t2 in FIG. 7, the control device waits for a stacker synchronization clock signal to be supplied by the synchronization-signal transmitter assigned to the stacker wheel 20. With the rear flank of the stacker synchronization clock signal shown in e) of FIG. 7, the clutch 56 is coupled and the brake 58 is released (point in time t2 in FIG. 7), with the result that, following the point in time t2 in FIG. 7, both the stacker wheels and the separator start up synchronously until the operating speed Vmax has been reached.

Since, during the period of time between the synchronization clock signals from the separator and from the stacker, that is to say between t1 and t2 in FIG. 7, the speed of the stacker wheels (which also corresponds to the speed of the transporting means between the separator and the stacking wheels) is constant, this period of time between t1 and t2 corresponds to an adjusted or corrected phase position between the separator and the transporting and stacker arrangement. This correct phase position, in which the two synchronization signals are supplied by the separator and the stacker wheels, is selected, by pre-adjustment of the machine, such that the banknotes arrive centrally in the sheet compartments of the stacker wheels. Moreover, the frequency at which the banknotes run into the stacker wheel corresponds to the discharging frequency at the separator.

In the case of the embodiment with separate drive motors for the separator, on the one hand, and transporting and stacker arrangement, on the other hand, a similar initializing routine to that shown in FIG. 7 is carried out, the only difference being that, instead of the coupling and braking operation, the drive motors 40 and 43 are activated directly to achieve synchronization.

During operation of the sheet-processing apparatus, it is then possible for the synchronization states to be monitored continuously. According to FIG. 7, during the period of time between t1 and t2, the control means had waited to start up the apparatus as a whole until the stacker synchronization clock had been produced. Once the operating speed increases to the maximum operating speed Vmax, the control device then receives the two synchronization clock signals from the separator and from the stacker wheels at the same time, the period duration being T and being indicated between the points in time t3 and t4 in FIG. 7. If, for example, the separator synchronization clock at d) is leading in relation to the stacker synchronization clock, then this means that the banknotes arriving at the stacker wheel moves somewhat closer to the tip of the preceding stacker finger 33 of the stacker wheel. In the case of the two synchronization clocks lagging, the banknote moves closer to the tip of the following stacker finger. Such deviation can be tolerated within certain limits. The control device may be programmed such that, up to a certain threshold value, it does not take any action. However, if such a threshold value is exceeded, then a readjustment can be carried out.

In the case of the embodiment according to FIG. 4 with a common drive motor, operation would have to be stopped, in the case of readjustment being necessary, in order to carry out the initializing sequence explained above with reference to FIG. 7.

In the case of the embodiment according to FIG. 3 with separate drive motors, the readjustment of the synchronization can be carried out during operation without the machine having to be stopped.

It is clear to the person skilled in the art that special details of the exemplary embodiments explained in more detail above can readily be modified without deviating from the scope of protection of the invention. The number of stacker wheels and associated depositing compartments can be varied. The abovedescribed mechanical synchronization of the stacker wheels by means of toothed belts can be replaced by other (also mechanical) means, for example intermediate gearwheels, shafts with bevel wheels or the like.

What is claimed is:

1. A sheet-processing apparatus for depositing sheets (BN) in stacks, comprising:

a separator (10) which directs individual sheets (BN) at a defined frequency into a sensor and transporting unit (8), senses the features of the sheets as depositing criteria and directs the sheets, in dependence on certain depositing criteria, to one of a plurality of stacker wheels (20, 22, 24), which are each assigned a depositing compartment (30, 32, 34), each of the stacker wheels (20, 22, 24) being provided with sheet compartments (37) which are distributed uniformly over the wheel circumference, are each formed by two circumferentially spaced-apart stacker fingers (33) and have an opening (○) which is formed by the outer tips of the stacker fingers (33) and via which a sheet is introduced into the sheet compartment before the sheet is discharged from the sheet compartment into the associated depositing compartment, the rotational speed of the stacking wheels (20, 22, 24) being synchronized with the frequency defined for the separator such that each sheet (BN) passing into a sheet compartment of the stacker wheel runs approximately centrally through the opening (○) of the sheet compartment (37), wherein a common drive motor (50) is provided for the separator (10) and the stacker wheels (20–24), and wherein the separator (10) is assigned a clutch (56) and preferably a brake (58), with the aid of which, during an initializing sequence, first of all the separator (10) is set to a defined synchronizing position and is uncoupled from the drive motor (50) in order then to bring the stacker wheels (20–24) into a predetermined synchronizing position before the separator (10) is coupled again.

2. The sheet-processing apparatus as claimed in claim 1, wherein the stacker wheels (20–24) are synchronized mechanically with one another.

3. The sheet-processing apparatus as claimed in claim 2, wherein the stacker wheels (20–24) are coupled to one another via one or more toothed belts (25, 27; 60, 62).

4. The sheet-processing apparatus as claimed in claim 3, wherein the stacker wheels (20–24) are each axially assigned a gearwheel (67), of which the number of teeth is identical to the number of sheet compartments or is a whole-numbered multiple of the number of sheet compartments or can be divided by the number of sheet compartments to give a whole number.

5. The sheet-processing apparatus as claimed in one of claim 1, wherein in each case one synchronization-signal transmitter (42, 21) is assigned to the separator (10) and to at least one of the stacker wheels (20).

6. The sheet-processing apparatus as claimed in claim 5, which comprises a control device (100) which receives synchronization signals from the synchronization-signal transmitter (42, 21) assigned to the separator and to the stacker wheel, and synchronizes the operation of the separator and of the stacker wheels.

7. The sheet-processing apparatus as claimed in claim 1, wherein the stacker fingers (33) have a defined minimum thickness, which guarantees a minimum spacing between parts of a sheet in one sheet compartment (37) and the sheet located in an adjacent sheet compartment.

8. The sheet-processing apparatus as claimed in claim 7, wherein the stacker fingers are of double-walled design in each case.

9. A process for setting up a sheet-processing apparatus which serves for depositing sheets in stacks and has:

a separator (10) which directs individual sheets (BN) at a defined frequency into a sensor and transporting unit (8), senses the features of the sheets as depositing criteria and directs the sheets, in dependence on certain depositing criteria, to one of a plurality of stacker wheels (20, 22, 24), which are each assigned a depositing compartment (30, 32, 34), each of the stacker wheels (20, 22, 24) being provided with sheet compartments (37) which are distributed uniformly over the wheel circumference, are each formed by two circumferentially spaced-apart stacker fingers (33) and have an opening (○) which is formed by the outer tips of the stacker fingers (33) and via which a sheet is introduced into the sheet compartment before the sheet is discharged from the sheet compartment into the associated depositing compartment, which comprises the following steps:

prior to operation, an initializing routine is carried out, this involving the separator (10) and the synchronously running stacking wheels (20, 22, 24) being synchronized with one another such that each sheet running into one of the sheet compartments (37) has its leading edge running through the opening (○) of the sheet compartment (37) approximately centrally between the tips of the stacker fingers (33), the initializing routine containing the following steps:

the separator (10) is moved into a defined synchronizing position and stopped;

the stacking wheels are then moved into a defined synchronizing position, and from the respective synchronizing position, the separator and the stacking wheels (20, 22, 24) are accelerated to the operating speed (Vmax) for the stacking operation.

10. The process as claimed in claim 9, wherein the initializing routine is carried out following each instance of intervention in parts of the sheet-processing apparatus which serve for transporting sheets.

11. The process as claimed in claim 10, wherein the synchronization of the separator and stacker wheels (20, 22, 24) is checked continuously, or at time intervals, during the stacking operation and, if appropriate, an initializing routine is introduced.

12. The process as claimed in claim 11, wherein the synchronization is checked with reference to synchronization signals which are supplied both by the separator and by the stacker wheels.

* * * * *